US006173460B1

(12) United States Patent
Mitchell

(10) Patent No.: US 6,173,460 B1
(45) Date of Patent: Jan. 16, 2001

(54) BED RAIL HOOK AND FASTENER ASSEMBLY

(75) Inventor: Herbert L. Mitchell, Asheboro, NC (US)

(73) Assignee: B & H Panel Company, Asheboro, NC (US)

( * ) Notice: Under 35 U.S.C. 154(b), the term of this patent shall be extended for 0 days.

(21) Appl. No.: 08/661,921

(22) Filed: Jun. 11, 1996

(51) Int. Cl.[7] ..... A47C 19/00; F16B 15/08
(52) U.S. Cl. ..... 5/292; 5/296; 411/455
(58) Field of Search ..... 5/286, 292, 293, 5/296; 411/455, 451

(56) References Cited

U.S. PATENT DOCUMENTS

| | | | | |
|---|---|---|---|---|
| 23,525 | * | 4/1859 | Buxton | 5/296 |
| 364,301 | * | 6/1887 | Rogers | 411/455 |
| 364,439 | * | 6/1887 | Rogers | 411/455 |
| 368,687 | * | 8/1887 | Rogers | 411/455 |
| 1,972,108 | * | 9/1934 | Richardson | 5/296 |
| 1,978,329 | * | 10/1934 | Rosenberg | 411/455 |
| 2,025,961 | * | 12/1935 | Stone | 411/455 |
| 2,028,528 | * | 1/1936 | Sipe | 411/455 |
| 2,132,131 | * | 10/1938 | Schilling | 5/286 |
| 2,160,174 | * | 5/1939 | Scalera | 5/296 |
| 2,211,980 | * | 8/1940 | Luppert | 5/286 |
| 2,242,537 | * | 5/1941 | Moore | 5/296 |
| 2,246,090 | * | 6/1941 | Filer | 5/286 |
| 2,305,063 | * | 12/1942 | Collins | 5/296 |
| 2,539,933 | * | 1/1951 | Silverman | 5/296 |
| 3,305,880 | * | 2/1967 | Cloutier | 5/296 |
| 3,528,693 | * | 9/1970 | Pearson et al. | 411/455 |
| 3,611,708 | * | 10/1971 | Moore et al. | 411/455 |
| 3,717,067 | | 2/1973 | Vick et al. . | |
| 3,861,527 | | 1/1975 | Perkins . | |
| 3,921,496 | | 11/1975 | Helderman . | |
| 4,148,106 | * | 4/1979 | Gallien | 5/296 |
| 4,718,802 | | 1/1988 | Rockenfeller et al. . | |
| 4,932,820 | | 6/1990 | Schniedermeier . | |
| 5,251,996 | | 10/1993 | Hiller et al. . | |

FOREIGN PATENT DOCUMENTS

| | | | | |
|---|---|---|---|---|
| 916048 | * | 1/1963 | (GB) | 411/455 |

* cited by examiner

*Primary Examiner*—Flemming Saether
(74) *Attorney, Agent, or Firm*—Rhodes & Mason, PLLC

(57) ABSTRACT

The present invention is directed to a bed rail hook and fastener assembly for hooking bed rails to the bedpost of headboards and footboards. The invention includes a bed rail hook configured to slide into the end of a bed rail and fasteners configured to extend partially through the bed rail and through apertures in the inserted portion of the bed rail hook in order to securely fasten the bed rail hook in the bed rail end. The same or similar fasteners used to secure the bed rail hook may also be oriented in the bedpost in a manner allowing downwardly extending hooks of the bed rail hook to engage the fasteners and securely hold the bed rail to the bedpost. The fasteners include a head, insertion end and a shank extending therebetween having annular ridges. Preferably, the annular ridges are frusto-conical and slope inwardly towards the insertion end. Additionally, a longer version of the hook fastener may be used to fasten a cleat for supporting bed slats along the lower side of the bed rail.

19 Claims, 4 Drawing Sheets

BED RAIL HOOK AND FASTENER ASSEMBLY

BACKGROUND OF THE INVENTION

The present invention relates generally to a bed rail hook assembly and, more particularly, to a hook assembly fastened to a bed rail by fasteners which provide high resistance to removal and increase structural integrity. High quality furniture products, especially those requiring some assembly during setup, require assembly components which are easy to use and provide a high degree of structural integrity once assembled. A rigid and sturdy furniture piece not only provides the appearance of quality, but also eliminates many problems which may occur later on, such as breakdowns and wobbling.

As with any type of manufacturing, economics is of primary importance. Currently, significant increases in structural integrity are accompanied by significant increases in cost. These costs are either passed on to the consumer, absorbed by the manufacturer or shared by both. Increases in material, machining and labor costs contribute to the increased cost associated with higher structural integrity.

Typically, a flat, metal plate having hooks for engaging a post associated with a headboard or footboard is mounted in a slot or on the side of a bed rail. The bed rail hook includes multiple apertures through which multiple fasteners extend in order to securely attach the plate to the bed rail. Currently, the furniture industry uses pegs to fasten the plate to the bed rail through pre-drilled apertures. Neither the fasteners nor the apertures extend completely through the bed rail, in order to provide a smooth, unobstructed and continuous wooden outer surface for the bed rail. Screws are not preferred because they would require additional time for insertion during manufacturing and add additional material costs. Predominantly, manufacturers use pegs held in place by staples that cover the heads of the inserted pegs. The staples aid in preventing the pegs from working loose. The peg and staple technique is more economical than screws, but provides less than optimum structural integrity. In both the screw and peg and staple fastening techniques, fast insertion, such as provided with pneumatic nail drivers, may split the wood surrounding the predrilled aperture or the wood on the side of the bed rail at the bottom of the aperture. Such a failure may significantly reduce the friction and hold provided by the fasteners and damage the bed rail aesthetically.

Fasteners having various types of threads and ridges have been used in other areas. However, these fasteners generally have a relatively small diameter and are directed at holding two materials together and resisting axial removal. A unique problem arises in relation to a bed rail fastener. Not only must the fastener resist axial removal, but the fastener must withstand concentrated shear forces perpendicular to the fastener shank associated with mounting the bed rail hook. The forces and associated shank wear are amplified because the bed rail hook must automatically orient itself to the most secure position when the bed rail is attached to the headboard or footboard post, and the fastener must not work loose over a long sequence of loadings and unloadings of the shear force. The fasteners of the prior art were not designed with such shear forces and wear in mind.

Thus, there is a need for a new and improved bed rail fastener assembly capable of providing significant structural integrity by using fasteners which are economical and providing substantial resistance to removal, while minimizing any splitting of the wood surrounding the predrilled fastener apertures. Furthermore, a fastener of larger diameter is needed to withstand the shear forces concentrated on the shank. A fastener is needed that will increase the amount of surface area contacting the predrilled apertures and the bed rail in order to further increase removal resistance. A further need remains for a hook assembly having additional fasteners mounted in a post of a headboard or footboard for the hook to engage during final setup and assembly.

SUMMARY OF THE INVENTION

The present invention fulfills that need by providing a bed rail hook and fastener assembly for hooking bed rails to the bedpost of headboards and footboards. The bed rail hook is configured to slide into a slot or be affixed to the side of the end of a bed rail. Fasteners, configured to extend partially through the bed rail and through apertures in the inserted portion of the bed rail hook, securely mount the bed rail hook in the bed rail end. The same or similar fasteners used to secure the bed rail hook may also be oriented in the bedpost in a manner allowing downwardly extending hooks protruding from the bed rail hook to engage the fasteners and securely support and hold the bed rail to the bedpost. The fasteners include a head, an insertion end and a shank extending therebetween having annular ridges. Preferably, the annular ridges are frusto-conical and slope inwardly towards the insertion end. Additionally, a longer version of the fastener may be used to fasten a cleat for supporting bed slats along the lower side of the bed rail.

Accordingly, an aspect of the current invention is to provide a hook and fastener assembly for fastening a hook in the end of a bed rail. The assembly includes a plurality of fasteners, each having a head, an insertion end and a shank disposed therebetween having a plurality of annular ridges wherein the annular ridges provide substantial removal resistance once inserted, and a bed rail hook having a flat body with a plurality of apertures extending through a first end of the body, wherein the bed rail hook apertures have a diameter larger than the ridges of the fasteners. The first end of the bed rail hook is adapted to engage a slot in an end of a bed rail having a plurality of partially through-extending apertures. The bed rail apertures have a diameter slightly smaller than the ridges of the fasteners. The bed rail hook apertures are further adapted to align with the bed rail apertures when the bed rail hook is inserted in the bed rail slot. During assembly, the fasteners are pressed into the bed rail apertures and through the bed rail hook apertures to provide a removal-resistant engagement.

Preferably, the insertion ends of the fasteners are blunt; however, tapered insertion ends may be used. The annular rings on the shank are preferably frusto-conical and sloped toward the insertion end to reduce the required insertion force while maintaining substantial removal resistance. The frusto-conical annular ridges often have a conical surface forming an angle of between fifteen (15) and seventy-five (75) degrees with a longitudinal axis of the shank and preferably form an angle of approximately thirty (30) degrees with the longitudinal axis of the shank. Typically, the heads of the fasteners are substantially flat and have a diameter greater than the diameter of the shanks. When tapered, the insertion ends of the fasteners may be conical.

The annular ridges may cover all or a portion of the shanks of the fasteners. If the annular ridges cover only a portion of the shank of the fastener, that portion is preferably adjacent the insertion end. However, the shanks of the fasteners will typically have a length slightly less than a thickness of the bed rail in order to prevent damaging and penetrating through a side of the bed rail opposite the bed rail apertures.

The bed rail hook typically includes a second end opposite the first end wherein the second end has a plurality of downwardly extending hooks adapted to engage a footboard or headboard post. The assembly may also include a second plurality of fasteners horizontally mounted through a slot in a bedpost so that the downwardly extending hooks of the bed rail hook may enter the slot of the bedpost and engage the respective shanks of the second plurality of fasteners.

Still another aspect of the present invention is to provide a fastener for use with a bed rail and hook assembly including a head; a blunt insertion end; and a shank disposed therebetween having a plurality of frusto-conical annular ridges. The annular ridges on the shank are sloped toward the insertion end to reduce the amount of force necessary for insertion while providing substantial removal resistance once inserted. The shank of the fastener has a length slightly less than a width of a bed rail end in order to prevent damaging and penetrating through a side of the bed rail.

Still another aspect of the present invention is to provide a hook and fastener assembly for fastening a hook in the end of a bed rail in conjunction with a bed rail cleat extending along the bed rail. The cleats are attached to the bed rail with fasteners having annular ridges along the shank. The fasteners may have the annular ridges only along the portion of the shank which will ultimately engage the bed rail.

Yet another aspect of the present invention is to provide a method of mounting a hook on an end of a bed rail. The method includes the following steps: a) providing a bed rail hook having a plurality of through-extending apertures; b) providing a bed rail having a slot in an end adapted to receive the bed rail hook and plurality of substantially through-extending apertures; c) providing a plurality of fasteners having a head, an insertion end and a shank disposed therebetween having annular ridges; d) aligning the plurality of apertures for the bed rail and bed rail hook; and e) pressing the fasteners into the bed rail apertures and through the bed rail hook apertures in a manner slow enough to prevent the substantial splintering or damage to the bed rail.

These and other aspects of the present invention will become apparent to those skilled in the art after a reading of the following description of the preferred embodiments when considered with the drawings.

DESCRIPTION OF THE PREFERRED EMBODIMENTS

Figure 1:
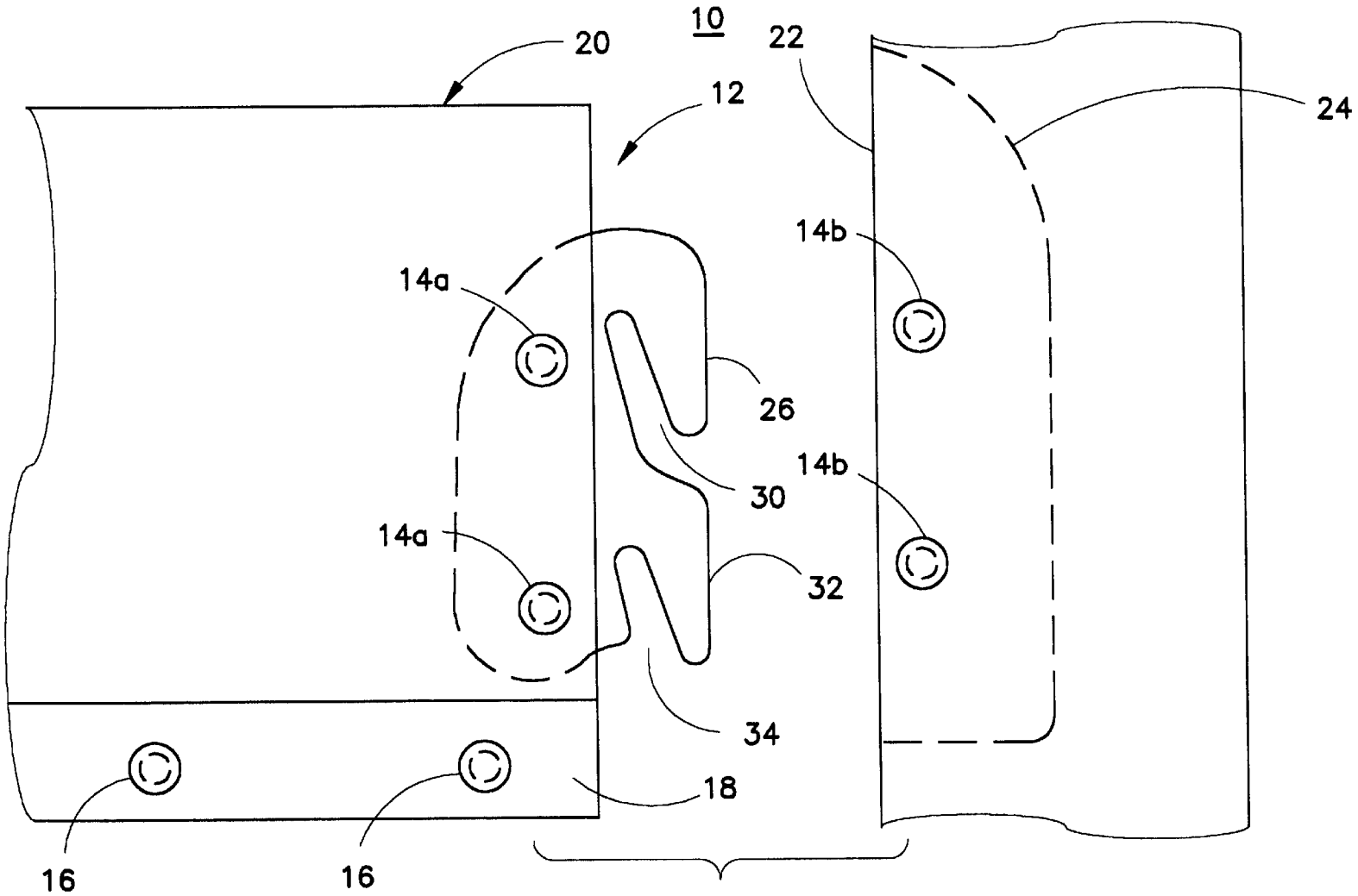
FIG. 1 is a side view of a bed rail having a hook and fastener assembly and a cleat assembly constructed according to a preferred embodiment of the present invention.

In the following description, like reference characters designate like or corresponding parts throughout the several views. Also in the following description, it is to be understood that such terms as "upwardly," "downwardly," and the like are words of convenience and are not to be construed as limiting terms. Referring now to the drawings in general, and FIG. 1 in particular, it will be understood that the illustrations are for the purpose of describing preferred embodiments of the invention and are not intended to limit the invention thereto.

As best seen in FIG. 1, a bed rail hook and fastener assembly, generally designated 10, is shown constructed according to the present invention. The hook and fastener assembly 10 includes a bed rail hook 12, multiple hook fasteners 14, and multiple hook engaging fasteners 15. The hook fasteners 14 and the bedpost fasteners 15 are preferably of similar type and size. Additionally, cleat fasteners 16, are used to fasten a cleat 18 along the bottom edge of a bed rail 20. The bed rail cleat 18 provides an edge on which to lay bed slats (not shown) which support the box springs and mattress (not shown).

The bed rail hook 12 is mounted at an end of the bed rail 20, when assembled, and engages the bedpost fasteners 15 mounted on bedpost 22. The bedpost 22 may be a leg or other supporting component of a headboard or footboard of a bed. Typically, the bed rail hook 12 slides into a slot 24 in the bedpost 22. The bed rail hook 12 includes a first downwardly extending hook 26 forming a first indentation 30 and at least a second downwardly extending hook 32 forming a second indentation 34. The downwardly extending hooks 26, 32 are initially inserted into slot 24 of the bedpost 22 and above the respective bedpost fasteners 15. The bed rail hook indentations 30, 34 are aligned with the bedpost fasteners 15 and moved inwardly and downwardly until the hooks 26, 32 of the bed rail hook 12 securely engage the bedpost fasteners 15.

Figure 2:
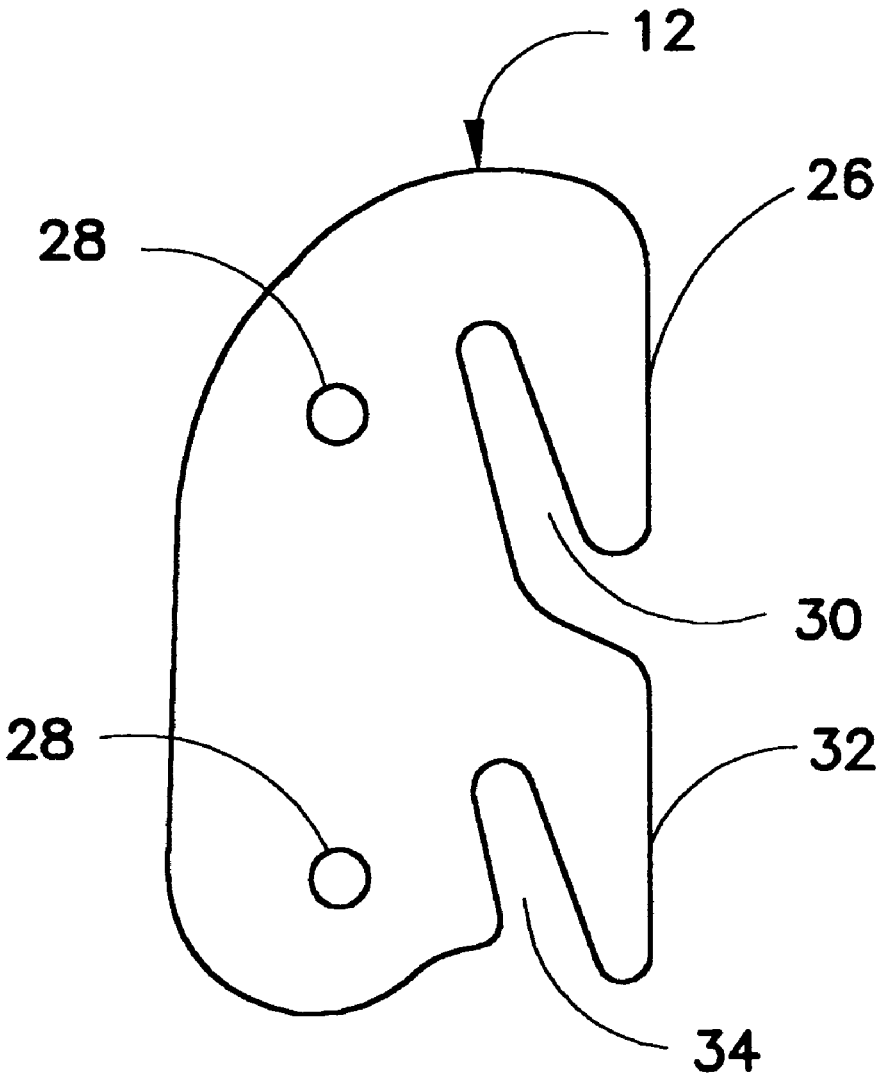
FIG. 2 is a side view of a bed rail hook as shown in FIG. 1.

An embodiment of the bed rail hook is shown in FIG. 2. The hook fasteners 14 extend through multiple hook apertures 28 when mounting the bed rail hook 12 to the bed rail 20. The apertures 28 are large enough to provide passage of the shank portion of the hook fastener 14 therethrough. The apertures 28 may be oversized and elongated to provide for a certain amount of play for the bed rail hook 12. Providing play in the bed rail hook 12 allows for slight adjustments in hook orientation as the bed rail 20 is mounted to the bedpost 22. The hook position will normally adjust and conform to a secure location and orientation. Providing oversized or elongated apertures 28 also allows for greater tolerances associated with the placement of the bedpost fasteners 15, which ultimately engage and hold the bed rail hook 12. However, providing the apertures 28 oversized may exacerbate the problem of changing shears on the fasteners, which in the prior art has led to fasteners working loose. The present invention reduces the severity of this problem.

Figure 3:
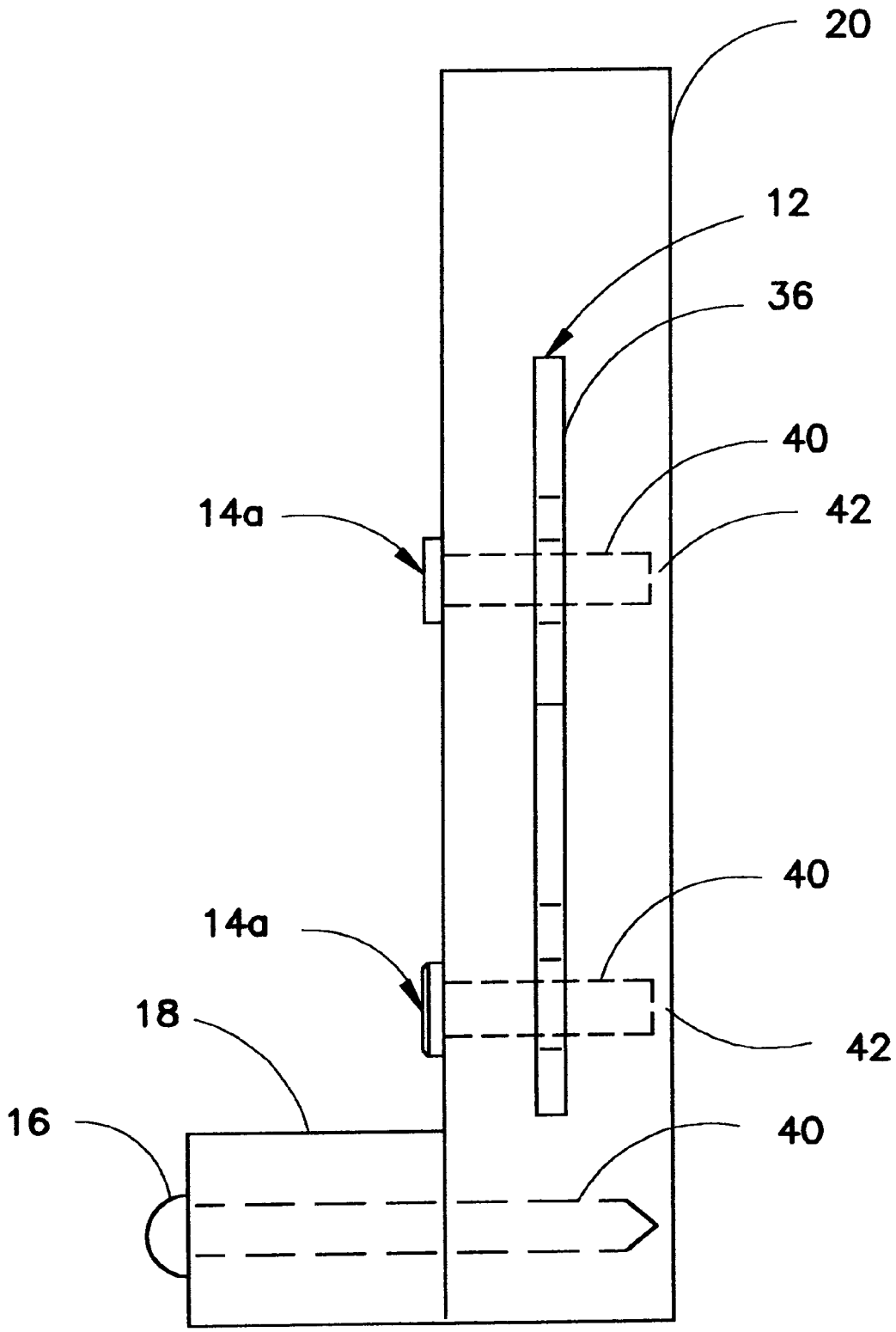
FIG. 3 is an end view of the bed rail having the hook and fastener assembly and cleat assembly constructed according to FIG. 1.

FIG. 3 depicts an end view of the bed rail 20 and the hook and fastener assembly 10. Although the bed rail hook 12 may be mounted on the side of the bed rail 20, it is preferably mounted in a slot 36 extending into the end of the bed rail 20. Initially, a number of apertures or bores 40*a*, 40*b*, 40*c* are made near the end and partially through one side of the bed rail 20. Preferably, the apertures 40*a*, 40*b* for the hook fasteners 14 do not extend completely through the bed rail 20, but extend from the one side past the slot 36 and into the other side of the rail. A remaining portion, designated 42, remains in order to provide an uninterrupted and unobstructed outer side of the bed rail for aesthetics. Thus, in the preferred embodiment, the hook fasteners 14 extend into the apertures 40*a*, 40*b* through the apertures 28 of the bed rail hook 12 and stop just prior to reaching the remaining portion 42. Increasing the fastener length increases the surface area contacting the inside of the apertures 40*a*, 40*b* and, thus, increases the friction created therebetween.

As also seen in FIG. 3, the cleat fasteners 16 also extend through a majority of the thickness of the bed rail 20. In general, the longer the aperture contacted by the fastener, the greater resistance to removal and loosening.

Figure 4:
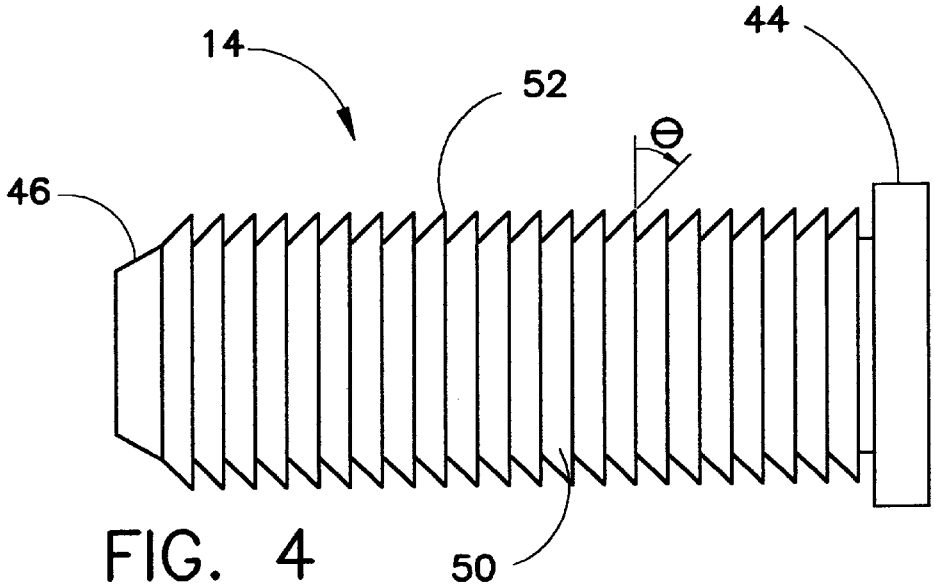
FIG. 4 is a side view of one embodiment of the fastener for the hook and fastener assembly constructed according to the present invention.
Figure 5:
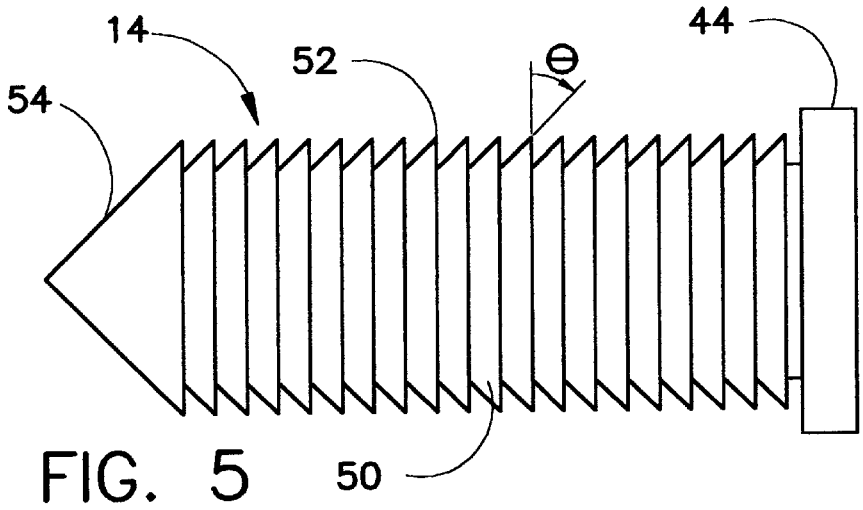
FIG. 5 is a side view of a second embodiment of the fastener for the hook and fastener assembly constructed according to the present invention.
Figure 6:
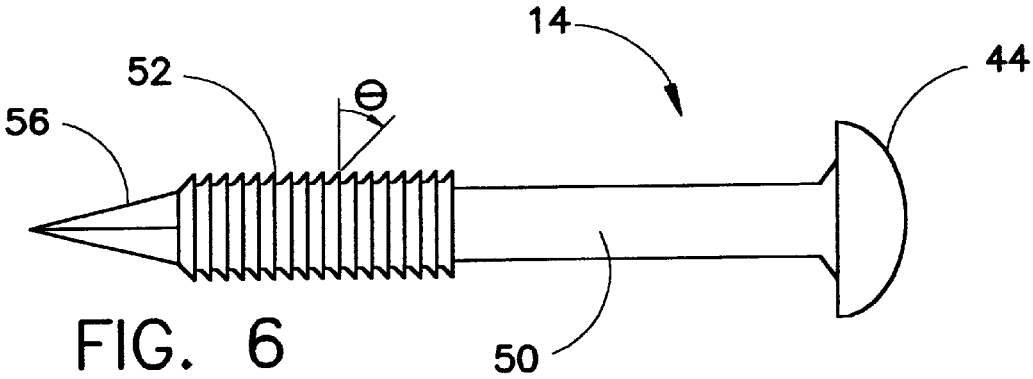
FIG. 6 is a side view of a third embodiment of the fastener for the hook and fastener assembly constructed according to the present invention.

Various embodiments of the fasteners 14, 15, 16 are shown in FIGS. 4–6. The bedpost fastener 15 may have the same configuration as the hook fasteners 14. Each fastener embodiment, depicted in FIGS. 4–6, 14*a*, 14*b*, 16 includes a head 44*a*, 44*b*, 44*c*, an insertion end 46, 54 or 56, and a shank 50*a*, 50*b*, 50*c* extending therebetween, as shown in FIGS. 4, 5 and 6 respectively. Each fastener type includes a plurality of annular ridges 52*a*, 52*b*, 52*c* encircling the respective shank 50*a*, 50*b*, 50*c*. The annular ridges 52*a*, 52*b*, 52*c* are adjacently spaced next to one another. The annular ridges 52*a*, 52*b*, 52*c* provide excellent removal resistance after insertion. Preferably, the annular ridges are frusto-conical with the conical surfaces inwardly sloped towards the insertion end 46, 54, 56, respectively. The upper surface of the frusto-conical ridges are preferably flat and perpendicular to the shank. When the annular ridges 52*a*, 52*b*, 52*c* are frusto-conical, the removal resistance is substantial, yet the force required for insertion is significantly reduced. Reducing the insertion force allows for the fasteners 14, 15, 16 to be pressed into the bed rail apertures 40*a*, 40*b*, 40*c* in a manner preventing the splitting of the wood around the apertures. A hydraulic press is used to relatively slowly press the fasteners into their respective apertures 40*a*, 40*b*, 40*c*. Slowly inserting the fasteners substantially reduces the amount of wood split during fastener insertion in relation to other fast insertion techniques. For example, nails have been known to be pneumatically shot into the wood, with splintering and fracturing of the surrounding wood surfaces.

The frusto-conical annular ridges 52*a*, 52*b*, 52*c* will typically form an angle ($\theta$) between the conical surfaces and an axis of the shank 50*a*, 50*b*, 50*c* between 15 and 75 degrees. Preferably, $\theta$ is approximately 30 degrees. As noted, as the diameter increases the amount of surface area contacting an annular ridge 52*a*, 52*b*, 52*c* increases.

The fasteners may have either a blunt insertion end 46 (as shown in FIG. 4) or a tapered insertion end 54 (as shown in FIG. 5). The blunt insertion end 46 helps maximize the number of annular ridges 52*a* contacting the bed rail aperture 40*a*, 40*b* and, thus, helps maximize removal resistance, since the number of annular ridges 52*a* along a set length of shank 50*a* is increased over embodiments using the tapered insertion end 54 (as shown in FIG. 5).

As seen in FIG. 6, a fastener embodiment particularly suited for the cleat fastener 16 is shown. The cleat fastener has a tapered insertion end 56 and, most notably, annular ridges 52*c* along only a portion of the shank 50*c*. The annular ridges 52*c* extend only along the portion of the shank which will reach the aperture 40*c* of the bed rail 20.

The type of insertion end used on any of the fasteners is dictated by the particular application. Applications requiring more assistance during insertion may use a tapered insertion end, while applications requiring less insertion assistance but requiring a maximum amount of surface area and annular ridges 52*a*, 52*b*, 52*c* engaging the bed rail aperture 40*a*, 40*b*, 40*c* may use a blunt end.

Furthermore, the size and shape of the head 44 of any of the fasteners will also be dictated by the particular application and insertion tool used. Certain applications may require an externally visible fastener head 44. In these applications, various head shapes and sizes will be used as aesthetically desired.

Given the substantial thickness of the fastener shank 50*a*, 50*b*, 50*c* substantial integrity and wear resistance is provided to counter the concentrated shear forces placed on the shank 50*a*, 50*b*, 50*c* by the relatively thin edge of the bed rail hook 12. Increasing the wear resistance of the bed rail hook 12 decreases the potential for complete fastener failure, and the amount of wobble and shake the bed may develop over its lifetime.

Certain other modifications and improvements will occur to those skilled in the art upon a reading of the foregoing description. It should be understood that all such modifications and improvements have been deleted herein for the sake of conciseness and readability but are properly within the scope of the following claims.

What is claimed is:

1. A wooden bed rail assembly comprising:

a wooden bed rail having a slot in one end thereof and a plurality of bed rail apertures extending generally perpendicularly and intersecting the slot so that portions of the aperture are on two sides of the slot, the apertures having a diameter;

a plurality of fasteners, each having a head, a blunt insertion end and a shank with a plurality of annular ridges between the head and the blunt insertion end, the annular ridges providing substantial removal resistance once the fasteners are inserted into a bed rail because of a ridge diameter that is greater than the bed rail aperture diameter; and a bed rail hook having a flat body with a plurality of apertures extending into the slot in the body, the bed rail hook apertures having a diameter larger than the annular ridges of the fasteners, the fasteners extending into the bed rail apertures and through the bed rail hook apertures so that the fasteners extend on both sides of the bed rail hook, and ridges on the fastener engage the bed rail on both sides of the slot to provide a removal resistant engagement, wherein the blunt end of each of the fasteners allows the shank to span nearly the entire thickness of the bed rail.

2. The assembly of claim 1 wherein said annular rings on said shank are frusto-conical and sloped toward said insertion end to reduce the amount of force necessary for insertion while maintaining substantial removal resistance.

3. The assembly of claim 2 wherein said frusto-conical annular ridges have a conical surface forming an angle of between fifteen (15) and seventy-five (75) degrees with a longitudinal axis of said shank.

4. The assembly of claim 2 wherein said frusto-conical annular ridges have a conical surface forming an angle of thirty (30) degrees with a longitudinal axis of said shank.

5. The assembly of claim 1 wherein said heads of said fasteners are substantially flat and have a diameter greater than said shanks of said fasteners.

6. The assembly of claim 1 wherein said shanks of said fasteners have a length slightly less than a width of the bed rail end in order to prevent damaging and penetrating through the bed rail opposite the bed rail apertures.

7. The assembly of claim 1 wherein said bed rail hook includes a second end opposite said first end, said second end having a plurality of downwardly extending hooks adapted to engage a footboard or headboard post.

8. The assembly of claim 7 further comprising a bedpost having a slot and a second plurality of fasteners transversely mounted through the slot in the bedpost, each of said fasteners having a head, insertion end and a shank disposed therebetween, said downwardly extending hooks of said bed rail hook configured to enter said slot of said bedpost and engage said shanks of said second plurality of fasteners respectively.

9. The assembly of claim 1 wherein said insertion ends of said fasteners are tapered.

10. The assembly of claim 1 wherein said insertion ends of said fasteners are conical.

11. The assembly of claim 1 wherein said shaft has a length-to-diameter ratio of around about 3.

12. A bed rail assembly comprising:

a wooden bed rail having a slot in one end thereof and bed rail apertures extending generally perpendicularly and intersecting the slot so that portions of the aperture are on two sides of the slot, the apertures having a diameter;

a plurality of fasteners, each having a head, a blunt insertion end and a shank with a plurality of frusto-conical annular ridges between the head and the blunt insertion end, the annular ridges on the shank being sloped toward the insertion end to provide reduced insertion force while providing substantial removal resistance once the fasteners are inserted into a bed rail; and a bed rail hook having a flat body with a plurality of apertures extending through a first end of the body, the bed rail hook apertures having a diameter larger than the annular ridges of the fasteners, the first end of the bed rail hook being adapted to enter the slot in the bed rail and to align with the bed rail apertures when the bed rail hook is inserted in the bed rail slot;

wherein during assembly the fasteners are pressed into the bed rail apertures and through the bed rail hook apertures so that the fasteners extend on both sides of the bed rail hook and ridges on the fastener engage the bed rail on both sides of the slot to provide a removal resistant engagement, wherein the blunt end of each of the fasteners allows the shank to span nearly the entire thickness of the bed rail.

13. The assembly of claim 12 wherein said shaft has a length-to-diameter ratio of around about 3.

14. A bed rail assembly as claimed in claim 12 further comprising:

a cleat extending along a length of the bed rail; and a plurality of cleat fasteners extending through the cleat and fastened into the bed rail to securely hold the cleat to the bed rail;

each cleat fastener having a head, an insertion end and a shank disposed between the head and the insertion end having a plurality of annular ridges, the annular ridges providing substantial removal resistance once inserted;

wherein during assembly the hook fasteners are pressed into the bed rail apertures and through the bed rail hook apertures and the cleat fasteners are pressed into the bed rail through the cleat to provide a removal resistant engagement.

15. The assembly of claim 14 wherein said shaft has a length-to-diameter ratio of around about 3.

16. A method of mounting a bed rail hook comprising:

positioning a bed rail hook having a plurality of through-extending apertures in a slot on an end of a wooden bed rail;

providing a plurality of fasteners having a head, a blunt insertion end and a shank having annular ridges between the head and the blunt insertion end;

aligning the plurality of apertures of the bed rail hook with apertures in the bed rail; and pressing the fasteners into the bed rail apertures and through the bed rail hook apertures in a manner slow enough to prevent the substantial splintering or damages to the bed rail and far enough to engage the bed rail with the ridges of the fastener on two sides of the bed rail hook, wherein the blunt end of each of the fasteners allows the shank to span nearly the entire thickness of the bed rail.

17. The method of mounting of 15 wherein said shaft has a length-to-diameter ratio of around about 3.

18. A bedpost connection using a fastener assembly comprising:

a wooden bedpost having a slot therein and apertures extending partially through the post and intersecting the slot; and a plurality of fasteners, each having a head, a blunt insertion end and a shank with a plurality of annular ridges between the head and the blunt insertion end, the annular ridges providing substantial removal resistance once inserted, the fasteners extending into the apertures in the bedpost so that they span the slot and annular ridges on the fasteners grip the bedpost on two sides of the slot to allow a bed rail hook to engage the fasteners within the slot, wherein the blunt end of each of the fasteners allows the shank to span nearly the entire thickness of the bedpost.

19. The bedpost connection of claim 18 wherein said fastener shaft has a length-to-diameter ratio of around about 3.

* * * * *